United States Patent [19]

Cooper et al.

[11] Patent Number: 4,970,192

[45] Date of Patent: Nov. 13, 1990

[54] PRESSURE-SENSITIVE COPYING PAPER

[75] Inventors: John B. Cooper, Lasne; Janet S. Stirling, Virginal, both of Belgium

[73] Assignee: The Wiggins Teape Group Limited, Basingstoke, England

[21] Appl. No.: 379,565

[22] Filed: Jul. 13, 1989

[30] Foreign Application Priority Data

Jul. 13, 1988 [GB] United Kingdom ..... 8816633

[51] Int. Cl.[5] ..... B41M 5/16; B41M 5/22

[52] U.S. Cl. ..... 503/200; 428/206; 428/211; 428/537.5; 503/207; 503/226

[58] Field of Search ..... 427/150–152; 428/211, 537.5, 321.5, 206; 503/200, 207, 226

[56] References Cited

U.S. PATENT DOCUMENTS 4,734,395 3/1988 Ogata et al. ..... 503/200

FOREIGN PATENT DOCUMENTS 0056200 7/1982 European Pat. Off. .
0156576 10/1985 European Pat. Off. .
1342839 1/1974 United Kingdom .
2031972 4/1980 United Kingdom .
1600862 10/1981 United Kingdom .
2177128 1/1987 United Kingdom .

*Primary Examiner*—Pamela R. Schwartz
*Attorney, Agent, or Firm*—Burns, Doane, Swecker & Mathis

[57] ABSTRACT

Microcapsule-coated paper for use in a pressure-sensitive copying set contains a higher than conventional filler loading, namely 15% to 23%, based on the total weight of the paper. The use of filler loading levels within this range increases the maximum number of legible copies obtainable in a pressure-sensitive copying set.

6 Claims, 6 Drawing Sheets

PRESSURE-SENSITIVE COPYING PAPER

This invention relates to pressure-sensitive copying paper, also known as carbonless copying paper.

Pressure-sensitive copying paper is well-known and is widely used in the production of business forms sets. Various types of pressure-sensitive copying paper are known, of which the most widely used is the transfer type. A business forms set using the transfer type of pressure-sensitive copying paper comprises an upper sheet coated on its lower surface with microcapsules containing a solution in an oil solvent of at least one chromogenic material (alternatively termed a colour former) and a lower sheet coated on its upper surface with a colour developer composition. If more than one copy is required, one or more intermediate sheets are provided each of which is coated on its lower surface with microcapsules and on its upper surface with colour developer composition. Imaging pressure exerted on the sheets by writing, typing or impact printing (e.g. dot matrix or daisy-wheel printing) ruptures the microcapsules thereby releasing or transferring chromogenic material solution on to the colour developer composition and giving rise to a chemical reaction which develops the colour of the chromogenic material and so produces a copy image.

The present invention is particularly concerned with base paper for coating with microcapsules to provide paper which may be converted into upper or intermediate sheets of the kind just described.

It is conventional for such base paper to contain an inorganic filler loading, typically of kaolin, calcined kaolin, calcium carbonate, titanium dioxide, or talc. The loading levels used vary from manufacturer to manufacturer but are typically in the range 7 to 13% by weight, based on the total weight of the paper.

Our research has shown that at these loading levels, there is no clear relationship between the loading level and the number of legible copies which may be obtained for a particular imaging pressure. Manufacturers naturally strive to provide their customers with papers which will permit a large number of copies to be made, and ability to produce copies of good legibility throughout a copying set with many plies is one of the key determinants of copying paper quality. It has therefore long been an objective in the art to provide copying paper which permits an increase in the number of legible copies which may be made, without of course making the paper unsatisfactory in other respects.

We have now found that the number of legible copies obtainable in a pressure-sensitive copying paper set may be increased by raising loading levels within the microcapsule-coated papers of the set compared with the loading levels conventionally employed, but that if the loading level is increased too much, the number of legible copies obtainable falls. Thus there is an unexpected band or "window" of loading level within which benefits can be obtained and outside which these benefits are not obtained.

European Patent Application No. 156576 A describes the production of pigments made up of aggregates of microcrystals of $CaF_2$ and/or $MgF_2$ bound together by a gelled silica polymer. One of the suggested uses of these pigments is as an opacifying pigment in base paper for subsequent coating to produce self-copying paper. The production of laboratory sheets of paper containing these pigments, in conjunction with kaolin, is described, together with comparisons in which kaolin alone is used. Pigment levels in these various sheets range from 20.7 to 30.9%. The sheets were not microcapsule coated, and there is no appreciation in European Patent Application No. 156576 A of the above-described effect of loading level on the number of legible copies obtainable.

According to the present invention, there is provided microcapsule-coated paper for use in a pressure-sensitive copying paper set and containing an inorganic filler loading, characterized in that the inorganic filler loading is at a level of from about 15% to about 23% by weight, more preferably 18 to 22% by weight, even more preferably 19 to 21% by weight, based in each case on the total weight of the paper.

The present invention also extends to a pressure-sensitive copying set using such a microcapsule-coated paper.

Although the present invention finds particular application in pressure-sensitive copying paper of the transfer type, it may also be applied to microcapsule-coated pressure-sensitive copying papers of the so-called self-contained type, i.e. papers in which both colour developer composition and microcapsules containing chromogenic materials in solution are present in one or more coatings on the same surface of the paper. Such papers are well-known in the art and so will not be described further herein.

The present microcapsule-coated paper may be used for both the top and the intermediate sheets of the copying set. When used for the intermediate sheets, it carries a colour developer coating on its surface opposite the surface carrying the microcapsules.

The inorganic filler used for the loading of the present paper is not critical, and may for example be any of the inorganic fillers conventionally used in pressure-sensitive copying papers, for example kaolin, calcined kaolin, calcium carbonate, titanium dioxide, or talc. Organic pigments may in principle be used in combination with the inorganic filler loading.

In other respects too, the present microcapsule coated paper may be conventional. Such paper is very widely disclosed in the patent and other literature, and so will not be discussed extensively herein. By way of example, however:

(i) the microcapsules may be produced by coacervation of gelatin and one or more other polymers, e.g. as described in U.S. Pat. Nos. 2800457; 2800458; or 3041289; or by in situ polymerisation of polymer precursor material, e.g. as described in U.S. Pat. Nos. 4001140; and 4105823;

(ii) the chromogenic materials used in the microcapsules may be phthalide derivatives, such as 3,3-bis(4-dimethylaminophenyl)-6-dimethylaminophthalide (CVL) and 3,3-bis(1-octyl-2-methylindol-3-yl)phthalide, or fluoran derivatives, such as 2'-anilino-6'-diethylamino-3'-methylfluoran, 6'-dimethylamino-2'-(N-ethyl-N-phenylamino-4'-methylfluoran), and 3'-chloro-6'-cyclohexylaminofluoran;

(iii) the solvents used to dissolve the chromogenic materials may be partially hydrogenated terphenyls, alkyl naphthalenes, diarylmethane derivatives, dibenzyl benzene derivatives, alkyl benzenes and biphenyl derivatives, optionally mixed with diluents or extenders such as kerosene;

(iv) the colour developer material, when present, may be an acid clay, e.g. as described in U.S. Pat. No. 3753761; a phenolic resin, e.g. as described in U.S. Pat.

No. 3672935; or an organic acid or metal salt thereof, e.g. as described in U.S. Pat. No. 3024927.

The thickness and grammage of the present paper (before microcapsule coating) may also be conventional, for example the thickness may be about 70 to 90 microns and the grammage about 49 g $m^{-2}$. Surprisingly, it has been found that there appears to be no correlation between the thickness of the present paper and the number of legible copies which may be obtained. Thus the unexpected benefits of a filler content within the range defined above cannot be explained simply on the basis that increased filler content results in increased paper density and therefore in reduced paper thickness, and thus in an increase in the number of legible copies obtainable. Even if such an explanation were valid however, it would not account for the surprising decrease in the number of legible copies obtainable once the optimum filler content of around 19 to 21% by weight is exceeded.

The benefits accruing from the use of a filler content within the ranges defined above are not dependent on the use of a particular papermaking process for incorporation of a filler loading. Thus a similar pattern of results has been obtained with papers made using a range of different known papermaking additive systems, for example systems using cationic starch and/or synthetic polymeric retention aids. Acid, neutral or alkaline sizing may be used.

BRIEF DESCRIPTION OF THE FIGURES

The figures graphically illustrate filler content versus legibility.

The invention will now be illustrated by the following Examples, in which all percentages are by weight unless otherwise stated and all filler contents quoted are based on ash content determinations:

EXAMPLE 1

Figure 1:
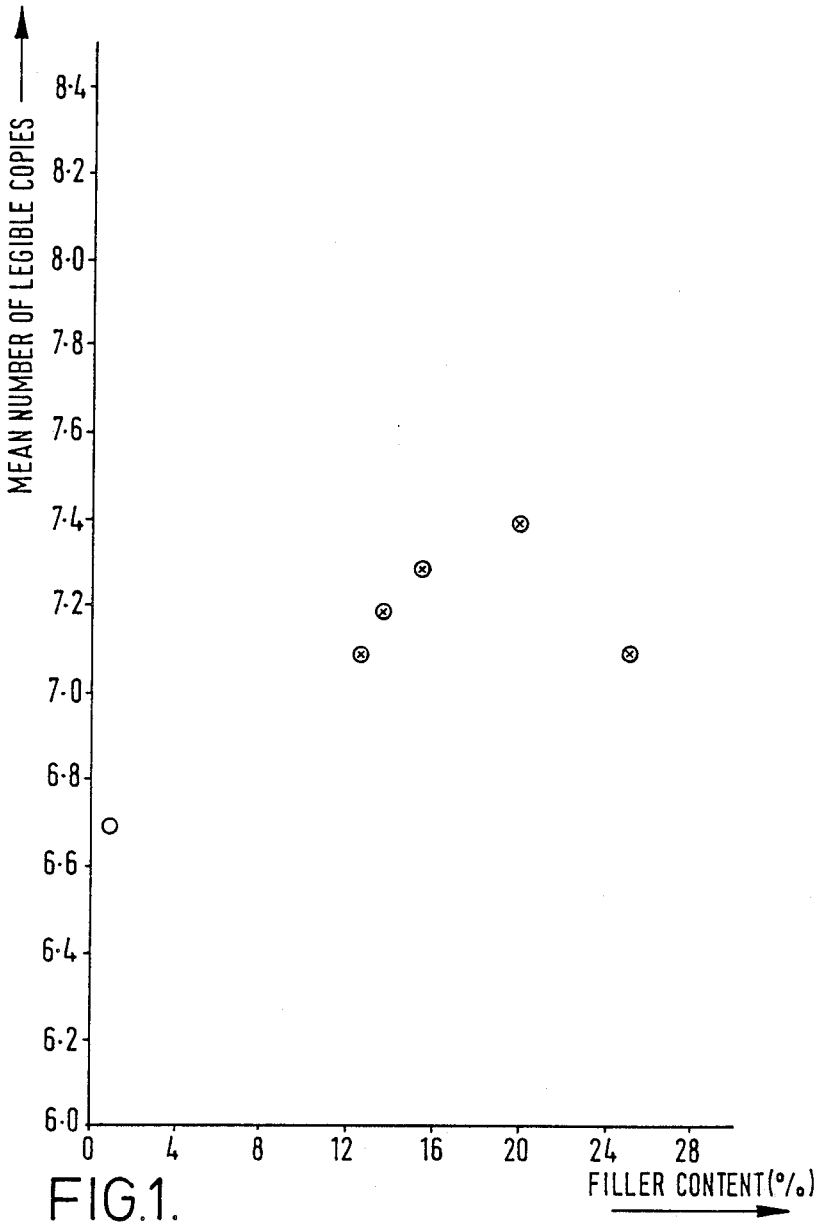

The loaded papers used in this Example were produced on a pilot-scale Fourdrinier paper machine using a process as disclosed in European Patent Application No. 227465 A.

A 2% aqueous mixed hardwood/softwood refined fibre suspension was made up and 1% aqueous solution of an anionic polyacrylamide retention agent was added to the fibre suspension in the machine chests with stirring. The level of polyacrylamide addition was 0.2% based on the weight of fibre present.

Separately, a 15% aqueous kaolin suspension was prepared and 1% anionic polyacrylamide solution was added with stirring at a level such as to give a polyacrylamide content of 0.2% based on the weight of kaolin. 10% cationic starch solution was added with further stirring. The cationic starch addition level on a dry basis was 8% based on the weight of kaolin.

The treated kaolin slurry was added to the fibre suspension, at a position in the approach flow system after the refiners, in various amounts intended to give a spread of different kaolin levels in a range of up to about 24%, based on the total weight of fibre and kaolin, after which the treated fibre suspensions were diluted to papermaking consistency. The final kaolin level in the paper does not match these target levels exactly in view of the unpredictability of factors such as retention of the kaolin in the sheet and uncontrollable variations in fibre and filler suspension flow rates. Alum and rosin size were successively added at the machine chest at levels of 2% and 0.8% respectively, based on the total fibre present. The various stocks were drained to produce paper webs of 49 g $m^{-2}$ target grammage. A 5% solution of solubilized starch was applied in each case by means of a size press on the papermachine. The pick-up was such as to produce a solubilized starch content of approximately 5% in the final paper web, based on the fibre content of the web.

The pressure-transmissibility of the resulting papers was then tested. These tests involved copy image formation using a conventional microcapsule-coated paper/colour developer paper imaging couplet in conjunction with a number of plies of the test (uncoated) base paper positioned above the imaging couplet. By making up a series of sets with different numbers of base paper plies above the imaging couplet, the copy produced on the colour developer paper of the couplet can be made to simulate, for example, the 6th copy sheet (5 superimposed sheets of base paper) or 7th copy sheet (6 superimposed sheets of base papers) and so on. Although the use of uncoated base paper plies does not replicate exactly the situation in practice (where all plies of the set would be coated), it has the advantage of eliminating potential distortions produced by uneven coatweight, and is therefore thought to give more valid results than if each ply were laboratory coated.

Copies were made in each case by using a programmable typewriter to produce the same 30 lines of randomly-arranged letters for each imaging couplet. The copies produced were then viewed by a 10-member test panel, each member of whom was required to read out a line of random letters. The highest copy ply number for which these letters could be read by each panellist without mistakes was noted, and the results for the ten members of the test panel were then averaged. This gave a number indicative of the maximum number of legible copies which could be obtained with a particular test paper (because of the averaging, the determined maximum number of legible copies is not usually a whole number).

The results obtained for the papers of different filler levels were as follows (the measured thicknesses of the papers are also quoted):

| Filler Content (%) | Mean No. of legible copies | Thickness (microns) |
|---|---|---|
| 0.8 | 6.7 | 74 |
| 12.6 | 7.1 | 74 |
| 13.6 | 7.2 | 74 |
| 15.4 | 7.3 | 72 |
| 19.9 | 7.4 | 73 |
| 25.2 | 7.1 | 71 |

The filler content/legibility results are depicted graphically in FIG. 1, and it will be seen that the number of legible copies reaches a maximum at around 20% filler content before falling back.

EXAMPLE 2

The loaded papers used in this Example were produced by a process using cationic starch and a conventional cationic polyacrylamide retention aid in the papermaking stock.

An aqueous fibre suspension was produced as described in Example 1 except that a 10% solution of cationic starch was added in the machine chest at a level of 1.5%, based on the weight of fibre present, in place of the anionic polyacrylamide used in Example 1.

A kaolin slurry was made up as described in Example 1 except that the additions of anionic polyacrylamide and cationic starch were omitted. This slurry was added to the fibre suspension at the mixing box, together with the retention aid at a level of 0.02%, based on the weight of dry fibre present.

In other respects, the process and testing procedure were as described in Example 1.

The results obtained were as follows:

| Filler Content (%) | Mean no. of legible copies | Thickness (microns) |
|---|---|---|
| 1.2 | 6.9 | 76 |
| 9.6 | 6.8 | 74 |
| 10.8 | 6.7 | 75 |
| 12.6 | 7.1 | 74 |
| 19.5 | 7.5 | 77 |
| 26.0 | 6.9 | 71 |

Figure 2:
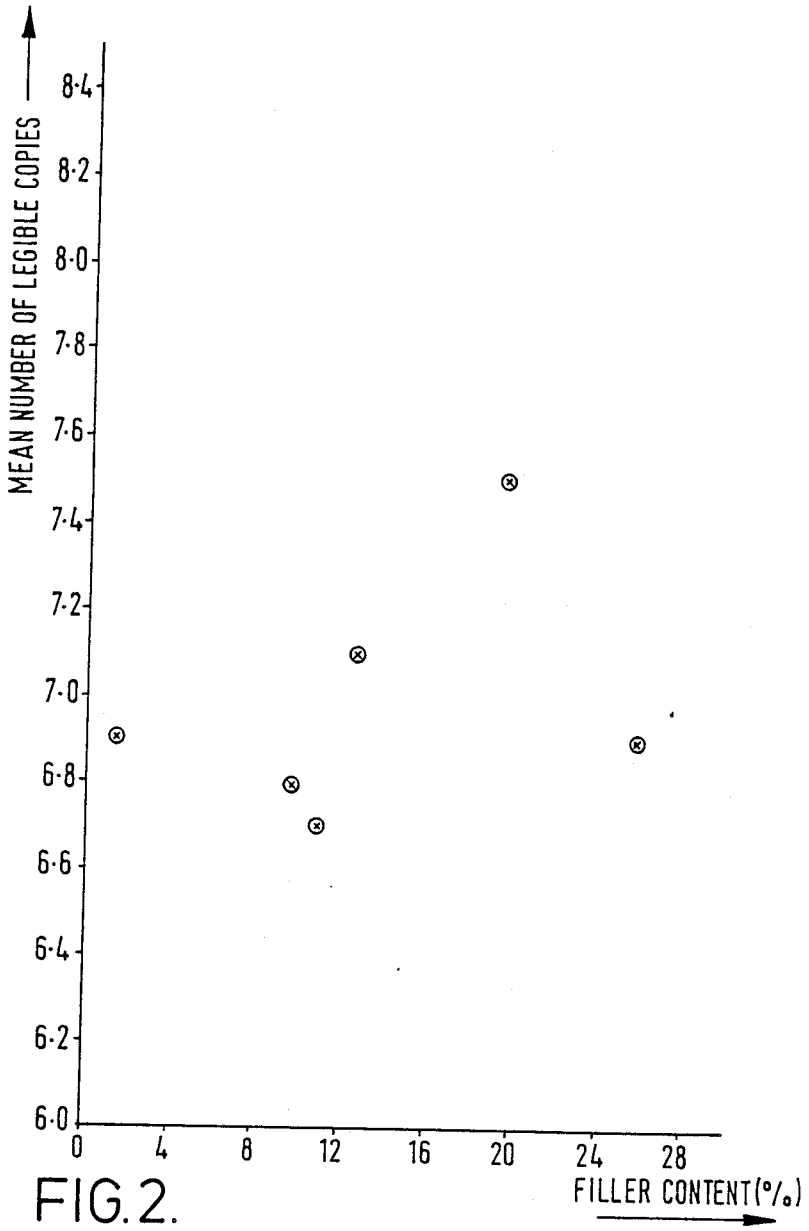

The filler content/legibility results obtained are depicted graphically in FIG. 2, and it will be seen that as in FIG. 1, the number of legible copies reaches a maximum at around 20% filler content before falling back. In contrast with Example 1 however, there is no steady trend at lower filler content of increasing legibility with increasing filler content.

EXAMPLE 3

The loaded papers in this Example were produced by a process using just a conventional retention aid in the papermaking stock.

The process was as described in Example 2 except that the addition of cationic starch to the fibre suspension was omitted. The nature and level of the retention aid used was as in Example 2.

The results obtained were as follows:

| Filler Content (%) | Mean no. of legible copies | Thickness (microns) |
|---|---|---|
| 0.9 | 6.8 | 74 |
| 8.8 | 6.9 | 75 |
| 10.7 | 7.1 | 72 |
| 12.2 | 7.0 | 72 |
| 19.9 | 7.5 | 74 |
| 25.8 | 6.3 | 74 |

Figure 3:
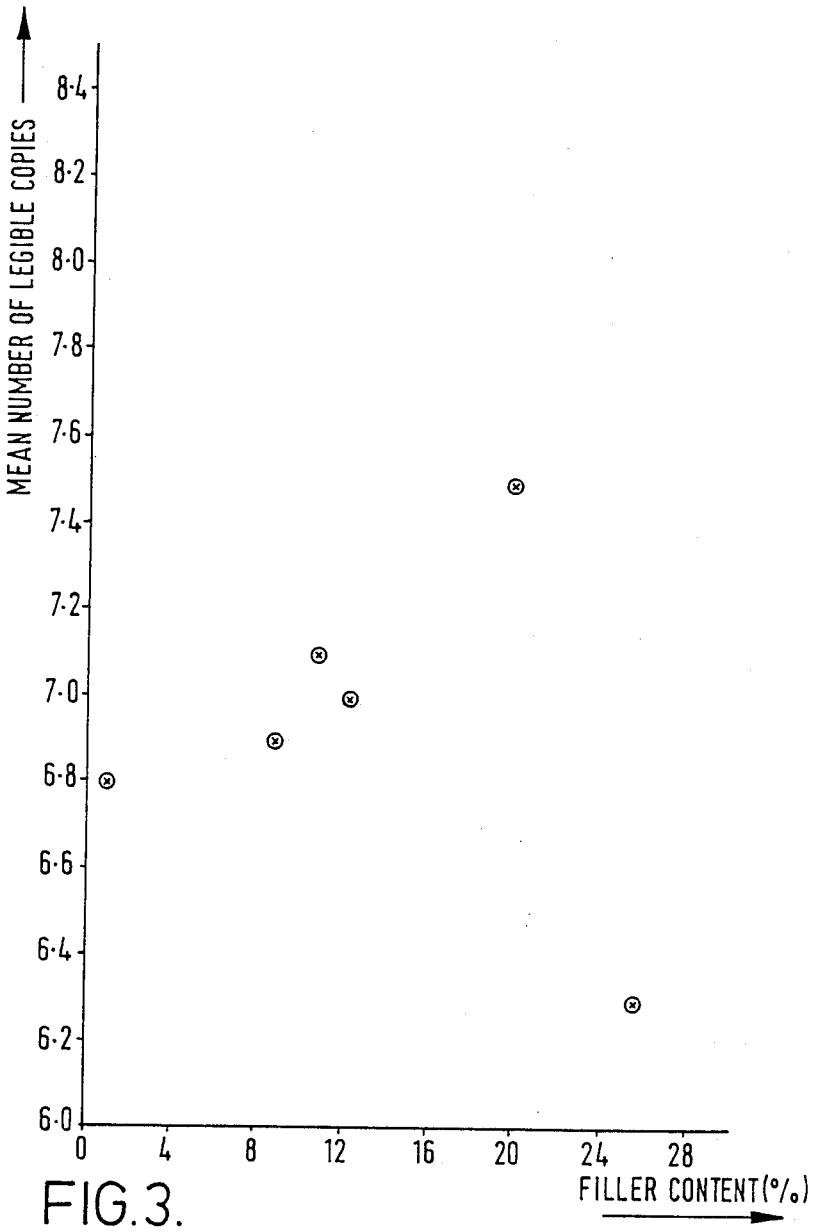

The filler content/legibility results obtained are depicted graphically in FIG. 3. As in FIGS. 1 and 2, the number of legible copies was greatest at around 20%. As in FIG. 2, no clear trend of legibility versus filler content emerges at lower filler content levels.

EXAMPLE 4

This Example is similar to Example 3 but differs in that a different grade of kaolin was used and in that the kaolin was added as a 10% suspension. The target grammage was slightly higher (50 g $m^{-2}$) and the papers made were of greater thickness than in previous Examples.

The results obtained were as follows:

| Filler Content (%) | Mean no. of legible copies | Thickness (microns) |
|---|---|---|
| 10.0 | 7.0 | 90 |
| 13.0 | 6.7 | 90 |
| 15.7 | 7.3 | 89 |
| 17.7 | 8.0 | 86 |
| 19.5 | 8.1 | 85 |

-continued

| Filler Content (%) | Mean no. of legible copies | Thickness (microns) |
|---|---|---|
| 20.3 | 8.2 | 91 |
| 22.1 | 8.0 | 90 |

Figure 4:
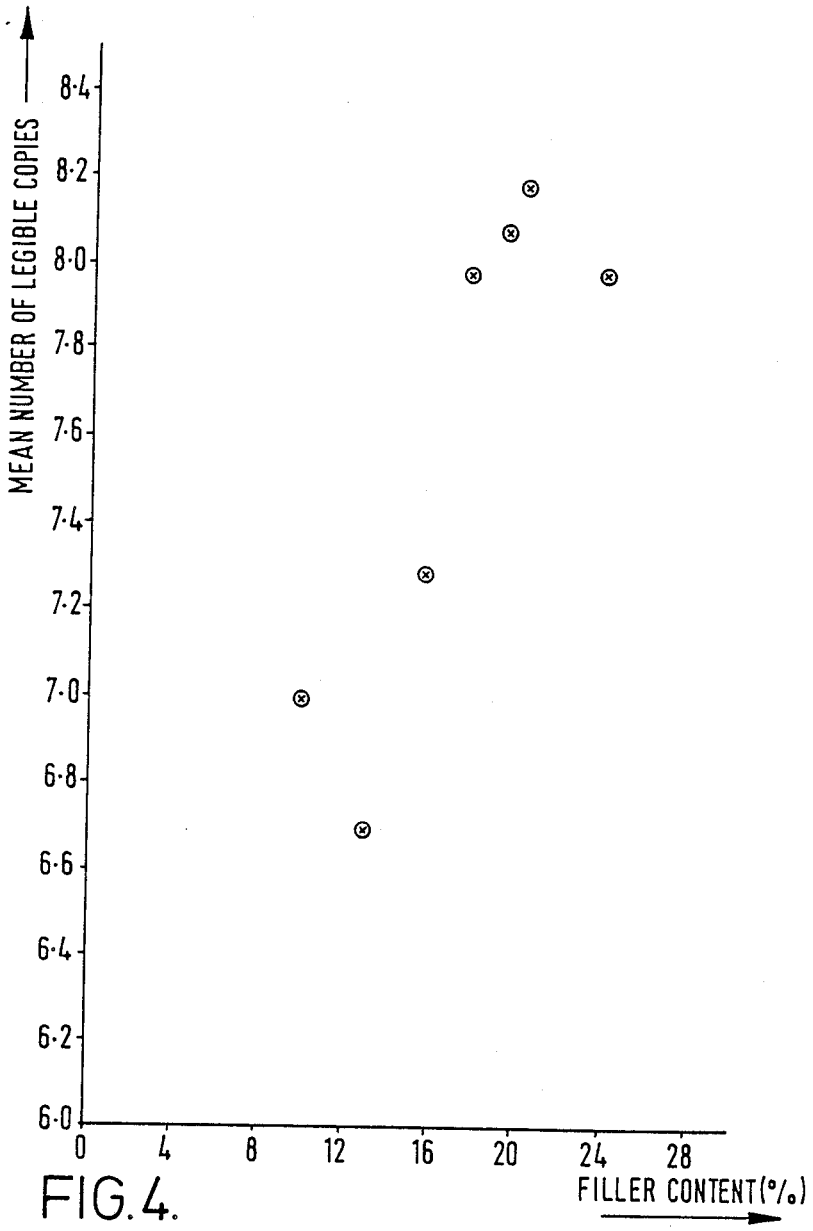
Figure 5:
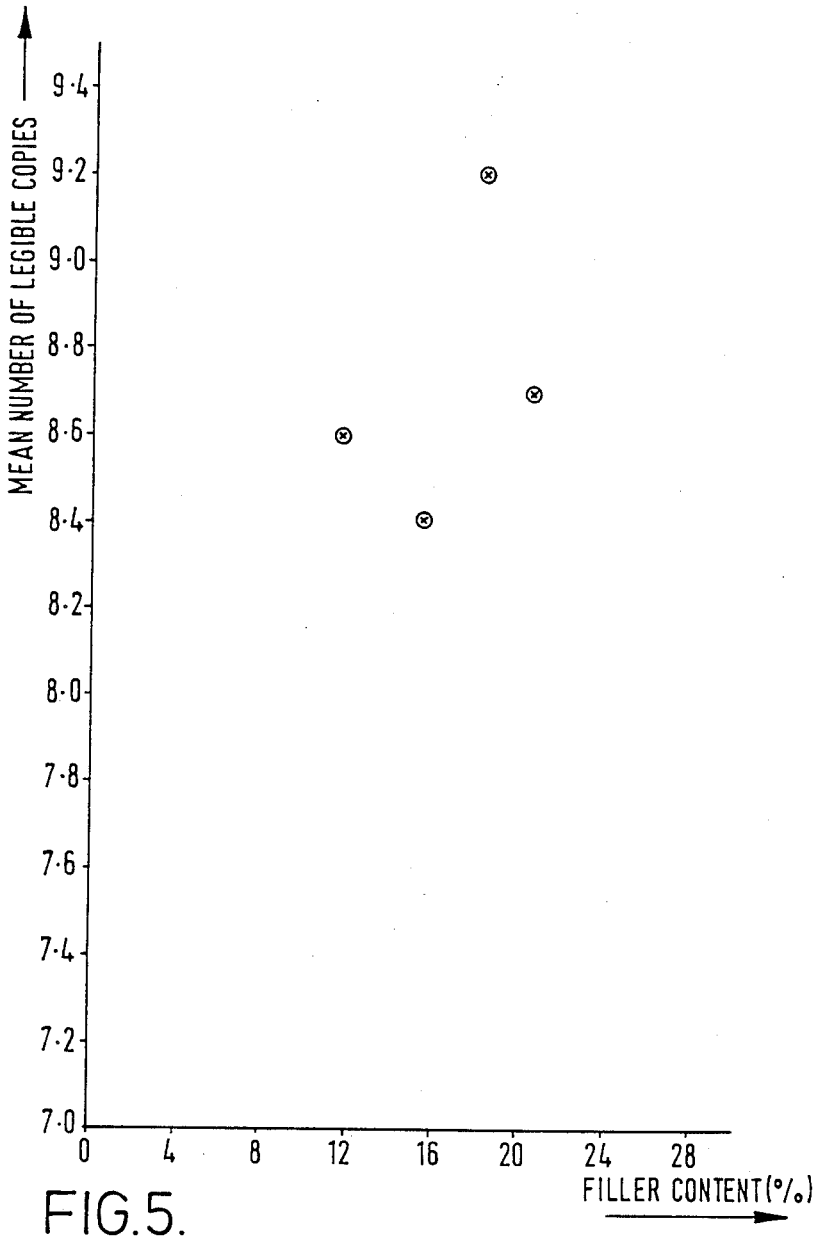

The filler content/legibility results obtained are depicted graphically in FIG. 4. As previously, the number of legible copies peaked at about 20% filler content before falling off.

EXAMPLE 5

This Example was generally similar to Example 1, except that:

a) a full-size Fourdrinier paper machine was used;

b) the anionic polyacrylamide solution used for both fibre and filler treatment was at a concentration of 0.5% (although the final treatment level remained at 0.2% in each case);

c) the cationic starch solution used for filler treatment was at a concentration of 3% (although the final treatment level remained at 8%);

d) the aqueous kaolin suspension was drawn from a ring main at 35% solids content and the treating solutions were added directly to this suspension;

e) the treated kaolin slurry and the treated fibre suspension were mixed just prior to the machine chest to give target filler contents of 12%, 14%, 16%, and 18%, although in the event generally higher filler contents were actually obtained.

The paper was tested as described in Example 1, and the results were as follows:

| Filler Content (%) | Mean No. of legible copies | Thickness (microns) |
|---|---|---|
| 11.6 | 8.6 | 66 |
| 15.4 | 8.4 | 65 |
| 18.1 | 9.2 | 65 |
| 20.4 | 8.7 | 63 |

The filler content/legibility results obtained are depicted graphically in FIG. 4, and it will be seen that the number of legible copies reaches a peack at around 18% filler content before falling back. This peak is at a lower level than in earlier Examples. However, the 20.4% filler content result is thought to be unreliable in that it had a higher grammage (51 g $m^{-2}$) than the remaining papers (49.4 to 49.8 g $m^{-2}$), and this would be expected to reduce the number of legible copies obtainable. The low legibility result for the 15.4% filler content is probably also anomalous, viewed in the light of the results from other Examples.

Some of the paper produced was then microcapsule coated on a pilot plant full-size paper coater using a microcapsule composition as conventionally used in commercial production of pressure-sensitive copying paper. This produced paper as used for the top sheet of pressure-sensitive copying sets. A further portion of the paper produced was coated on the pilot plant coater with a clay colour developing composition. This produced paper as used for the bottom sheet of pressure-sensitive copying sets. Some of the clay coated paper thus produced was additionally coated (on its surface opposite the clay-coated surface) with microcapsules. This produced paper as used as the intermediate sheets of pressure-sensitive copying sets. When these various papers were incorporated in a 4-ply pressure-sensitive copying set, it was found to give satisfactory copies throughout the set.

DISCUSSION OF RESULTS OF EXAMPLES AS A WHOLE.

Whilst there is a considerable degree of scatter in the results obtained for the various Examples, the overall trend is plain. The maximum number of copies always rises to reach a peak, usually at about 20% filler content, after which it falls off. At the filler levels currently used in base papers for microcapsule coating to produce pressure-sensitive copying papers, i.e. 7 to 13% by weight, there is no clear relationship between filler content and maximum number of legible copies. Thus it is all the more surprising that there is improved legibility at higher filler contents, and that there is a peak at around 20% filler content by weight, i.e. in the range 19 to 21% by weight. Significant legibility improvements compared with conventional legibility levels are achieved from about 15% filler content to about 23% filler content by weight, particularly at 18 to 22% filler content by weight. All the filler contents just quoted are based on the total weight of the paper.

Figure 6:
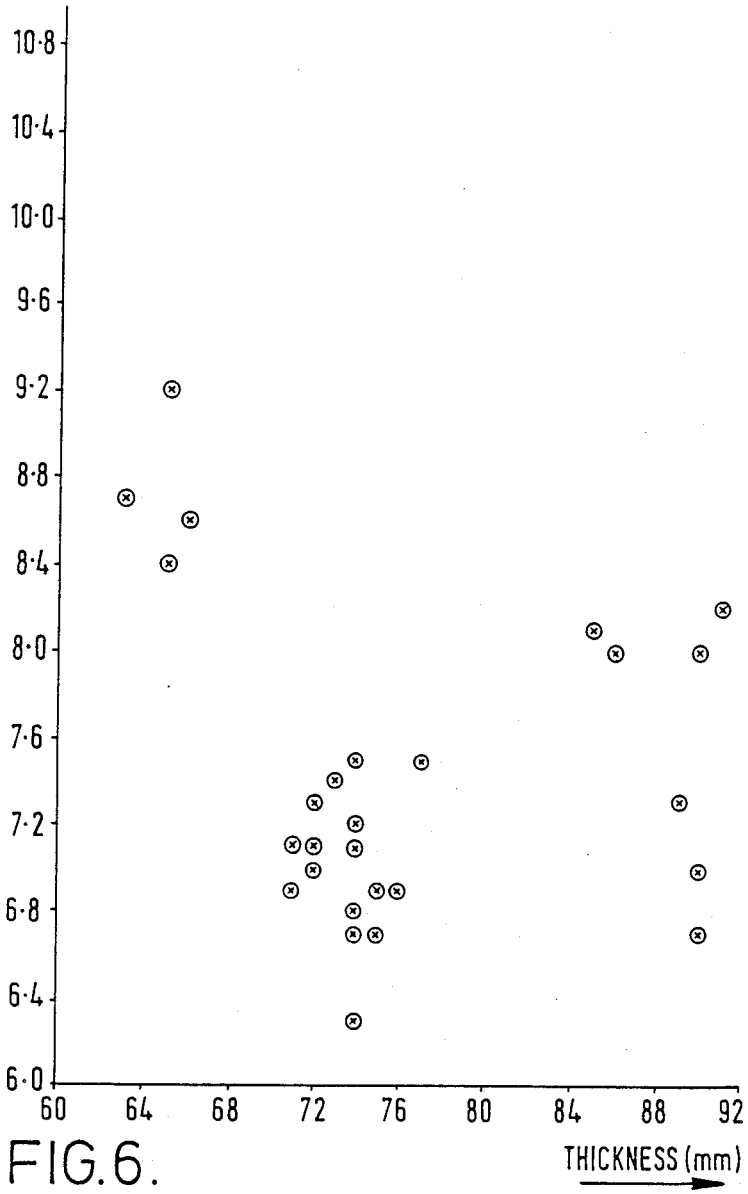

These effects appear not to be due to thickness effects, which show no clear trend. This can be seen plainly from FIG. 6, which is a plot of mean number of legible copies against thickness.

We claim:

1. Microcapsule-coated paper for use in a pressure-sensitive copying set including a coating having microcapsules of chromogenic material and containing an inorganic filler loading within the thickness of the paper, the inorganic filler loading being at a level of from 15% to 23% by weight, based on the total weight of the paper.

2. Microcapsule-coated paper as claimed in claim 1, wherein the inorganic filler loading level is from 18% to 22% by weight, based on the total weight of the paper.

3. Microcapsule-coated paper as claimed in claim 2, wherein the inorganic filler loading level is from 19% to 21% by weight, based on the total weight of the paper.

4. A pressure-sensitive copying set comprising at least two sheets of paper containing an inorganic filler loading within the thickness of the paper, at least one of the two sheets being coated with microcapsules having a chromogenic material therein, wherein the inorganic filler loading is at a level of from 15% to 23% by weight, based on the total weight of the paper.

5. A pressure-sensitive copying set according to claim 4 wherein the inorganic filler loading is in the range of 18 to 22% by weight, based on the total weight of the paper.

6. A pressure-sensitive copying set according to claim 5 wherein the inorganic filler loading is in the range of 19 to 21% by weight, based on the total weight of the paper.

* * * * *